US005809731A

United States Patent [19]

Reiss

[11] Patent Number: 5,809,731

[45] Date of Patent: Sep. 22, 1998

[54] BUILDING WALL DRAINAGE APPARATUS

[76] Inventor: David R. Reiss, 1813 Brookly Rd., Ashton, Ill. 61006

[21] Appl. No.: 879,145

[22] Filed: Jun. 19, 1997

[51] Int. Cl.[6] ..... E04C 2/08; E04C 2/20

[52] U.S. Cl. ..... 52/533; 52/302.1; 52/169.5; 52/478

[58] Field of Search ..... 52/533, 302.1, 52/518, 519, 474, 478, 539, 169.5

[56] References Cited

U.S. PATENT DOCUMENTS

| | | |
|---|---|---|
| 3,120,082 | 2/1964 | Mendelsohn . |
| 3,158,960 | 12/1964 | Newton et al. . |
| 3,246,436 | 4/1966 | Roush . |
| 4,102,106 | 7/1978 | Golder et al. . |
| 4,327,528 | 5/1982 | Fritz . |
| 5,076,037 | 12/1991 | Crick et al. . |

*Primary Examiner*—Christopher Kent
*Assistant Examiner*—Yvonne Horton-Richardson
*Attorney, Agent, or Firm*—Leydig, Voit & Mayer

[57] ABSTRACT

Drainage system apparatus for collecting water from exterior walls of a building and directing the water to predetermined locations spaced away from the foundation of the building to prevent basement flooding. The apparatus uses a pitched conduit attached to an exterior wall of the building which collects and carries the water to a selected location. A siding member is also attached to the wall so that it covers the conduit to give the apparatus an appearance that is consistent with the rest of the wall. The siding member has slots to allow water to pass through the siding member and into the conduit. A starter strip secures the bottom edge of the siding member and incorporates means for discharging water overflowing the conduit at points spaced from the foundation.

20 Claims, 3 Drawing Sheets

BUILDING WALL DRAINAGE APPARATUS

FIELD OF THE INVENTION

The present invention generally relates to the collection and drainage of water from buildings and, more particularly relates to the collection and drainage of water from exterior building walls.

BACKGROUND OF THE INVENTION

During rainstorms, water often washes down the exterior walls of buildings to eventually reach the base of the building. The exterior walls are directly joined to a foundation such that the rainwater proceeds uninhibited from the walls to the foundation. Cracks or other passages in the foundation allow the water to pass through the foundation and collect in the basement of the building.

Unfortunately, no devices are known which address this problem. Gutters are commonly used to collect rain from a building roof. Conventional gutters therefore do not aid in collecting or redirecting water striking the side of the house. Furthermore, conventional gutters cannot practically be adapted to collect water from the side of a house for a number of reasons. First, such gutters would have to be located near the base of a building along its periphery and, therefore, would create a potential hazard to people walking near the perimeter of the house. In addition, such a gutter system can be easily and inadvertently damaged. Conventional gutters also become clogged with objects such as leaves or sticks. Furthermore, such a gutter system would be visually unappealing.

SUMMARY OF THE INVENTION

In light of the foregoing, it is an object of the present invention to provide drainage apparatus for collecting water from the exterior walls of a building and redirecting that water away from the foundation of the building.

A more detailed object of the present invention is to provide drainage apparatus which is not easily damaged.

Another object of the present invention is to provide drainage apparatus which minimizes the potential for such apparatus to become clogged.

Still another object of the present invention is to provide drainage apparatus which does not detract from the appearance of the exterior wall and is visually appealing.

Accordingly, the present invention comprises a conduit for collecting and carrying water to predetermined locations for discharge. The conduit is attached to the exterior wall of a building and is covered by a siding member having slots. The slots allow water to pass from the exterior of the siding member to the interior and, ultimately, to collect in the conduit. The conduit is pitched so that the water travels in a preselected direction until it reaches a drain, whereupon the water is discharged from the conduit to a predetermined location.

It is, therefore, a feature of the present invention that the drainage apparatus is enclosed, thereby reducing the risk of inadvertently damaging the apparatus. The drainage apparatus also incorporates a series of slots which are sized to allow water to pass but restrict the entrance of large objects such as leaves, thereby reducing the chances that the drainage apparatus will become clogged. In addition, the drainage apparatus has a siding member that has a similar shape and appearance to the rest of the exterior wall. Moreover, the siding member has a plurality of lips disposed near the slots to help guide water through the slots and hide the slots from view.

These and other objects, advantages, and features of the invention will become more apparent from the following detailed description when taken in conjunction with the accompanying drawings.

Figure 1:
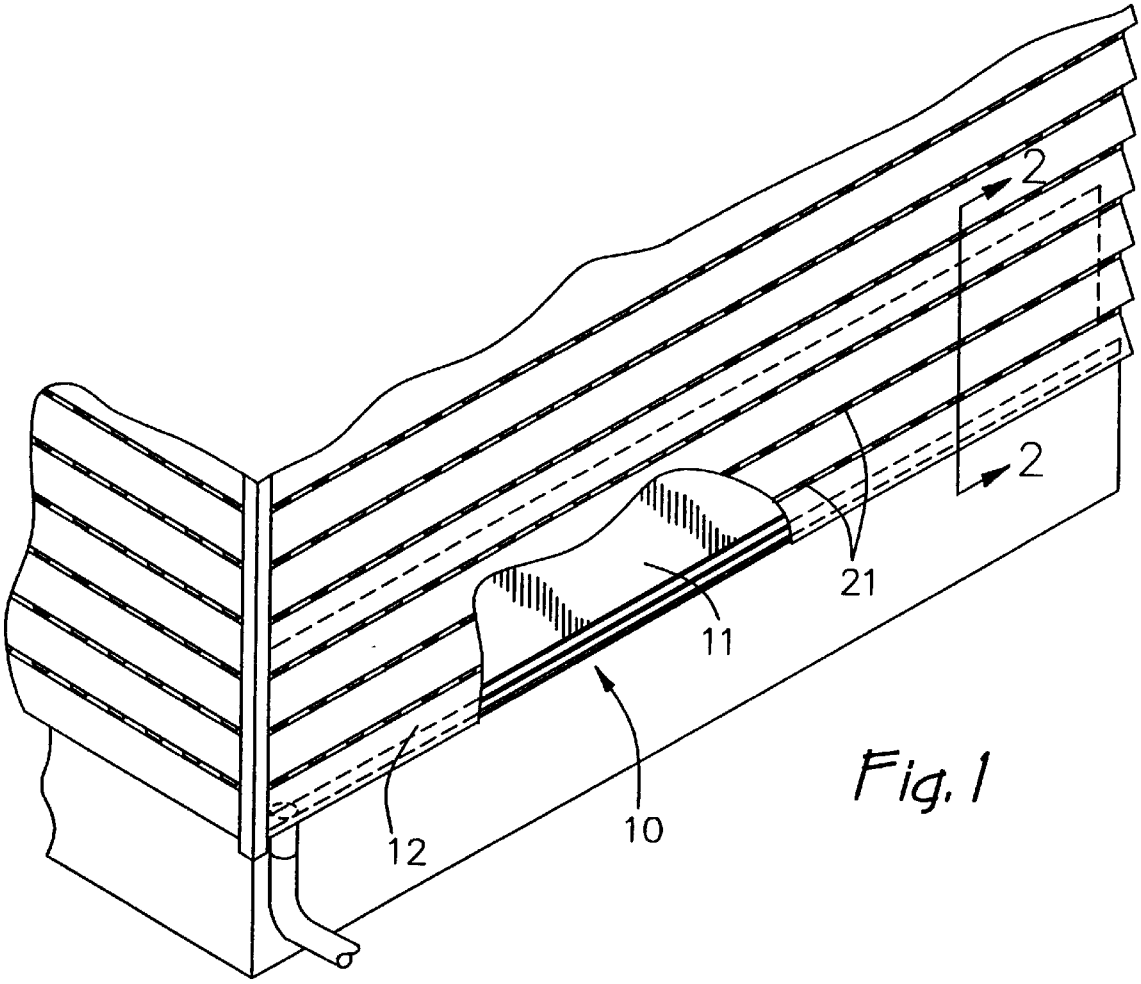
FIG. 1 is a perspective view showing the drainage apparatus attached to the exterior wall of a building.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

For purposes of illustration, the invention is shown in FIG. 1 as embodied in drainage apparatus 10 having a conduit 11 and siding member 12. The drainage apparatus 10 is adapted for attachment to the exterior wall 14 of a building. In practicing the invention, water runs down the side of the exterior wall 14 and passes through the siding member 12 to be collected in the conduit 11 and directed to a predetermined location for discharge. As a result, water hitting the exterior wall of the building is prevented from reaching the concrete foundation, thereby reducing the amount of water collecting in the basement of the building.

Figure 2:
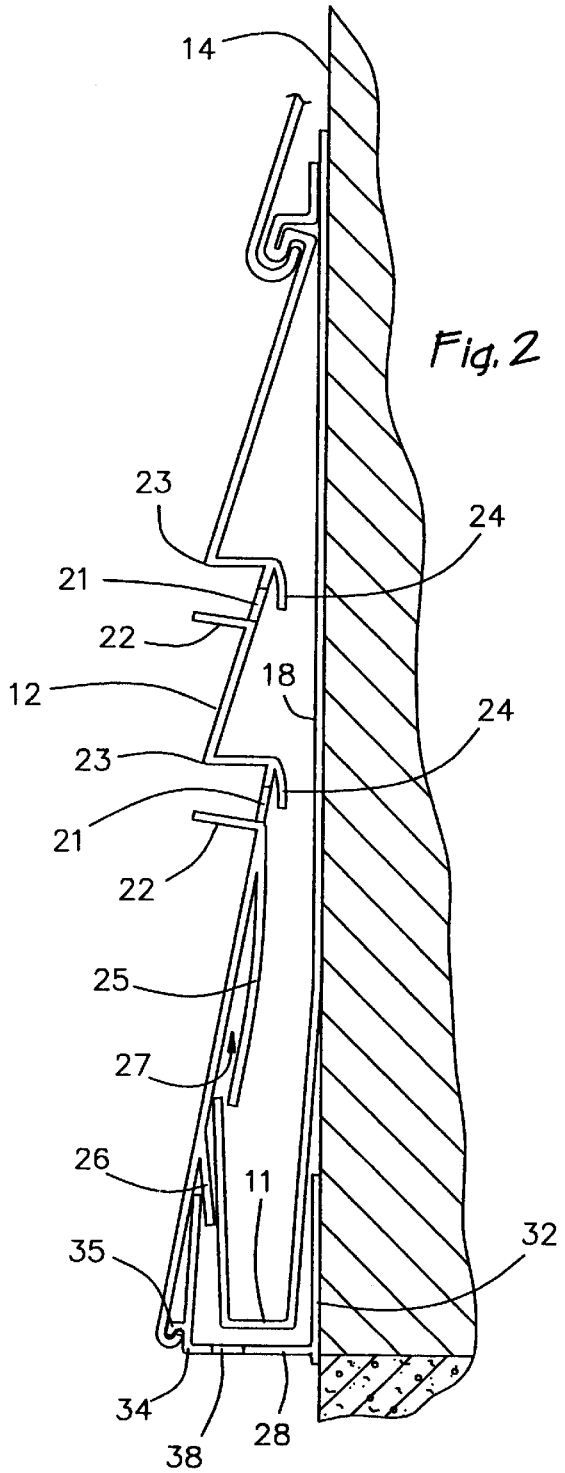
FIG. 2 is a sectional view of the drainage apparatus taken along line 2—2 of FIG. 1.
Figure 3:
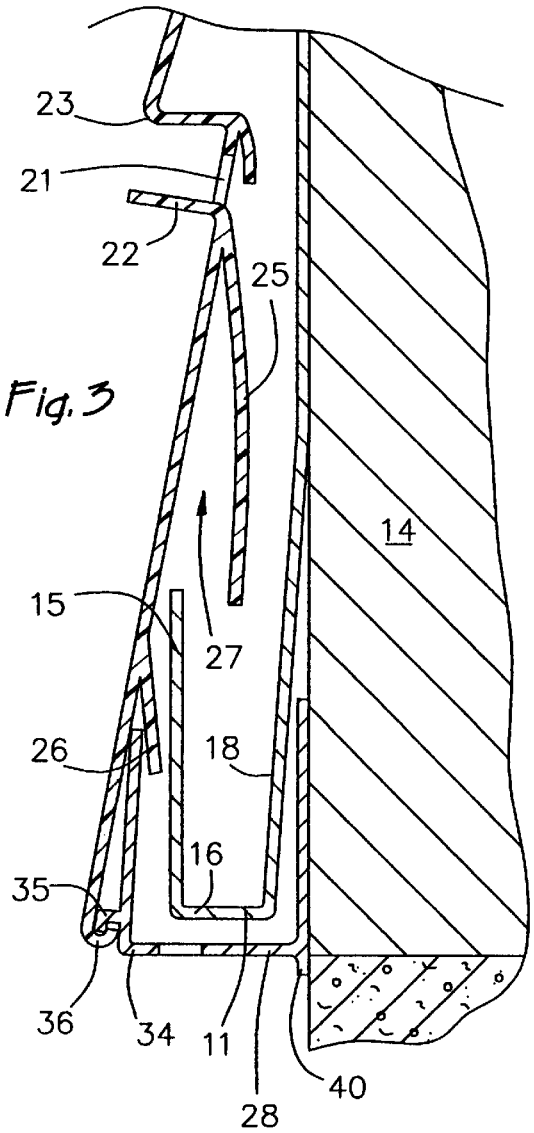
FIG. 3 is an enlarged sectional side view of the bottom of the drainage apparatus shown in FIG. 2.

The conduit 11 is provided for collecting and directing water to a discharge point, as best shown in FIGS. 2 and 3. The conduit 11 is formed into a channel comprising a front wall 15, a base 16, and mounting wall 18. The conduit 11 is attached to the exterior wall 14 using fasteners, such as nails, in such a manner that the conduit is inclined with respect to a horizontal reference plane or pitched. Therefore it will be appreciated that the pitch of the conduit causes water collecting in the conduit to travel toward a selected, lower end. It will further be appreciated that the conduit 11 may be formed of a plurality of conduit sections which are then connected to thereby span the entire length of the exterior wall 14. The side edges of the conduit 11 preferably taper inwardly from the base 16 so that when the conduit is pitched, an upper portion of the mounting wall 18 does not extend past the exterior wall 14.

The siding member 12 is provided for communicating water from the outside face of the siding member to the conduit 11. The siding member 12 has incorporated therein a series of slots 21 which allow water to travel from the exterior of the siding member 12 to the interior and, ultimately, to the conduit 11. As best shown in FIG. 1, the slots are disposed substantially horizontally along the siding member 12. It will be appreciated that the slots may comprise relatively long cutouts which extend along substantially the entire length of the siding member 12 or may comprise a plurality of shorter cutouts aligned horizontally across the length of the siding member, as illustrated in FIG. 1. In the preferred embodiment, the slots are sized to allow the passage of water but to restrict leaves and other objects from entering the conduit.

In the preferred embodiment, a lip 22 is disposed directly beneath each slot for directing water toward the slot and for improving the appearance of the apparatus. As best shown in FIG. 2, each lip 22 projects at an incline from the exterior side of siding member 12. In the illustrated embodiment, the exterior edge of the lip 22 is disposed substantially adjacent to a projecting bend 23 in the siding member 12. It will therefore be appreciated that water dripping from the bend 23 of the siding member 12 is caught by the lip 22 and directed toward the slots 21. In addition, the lip hides the adjacent slot 21 from view. When viewed from certain angles, the lips 22 completely cover the slots 21, thereby hiding the slots from view. The lips 22 are preferably formed integrally with the siding member 12 and have the same color as the rest of the siding member 12. As a result, the appearance of the apparatus is improved.

Figure 4:
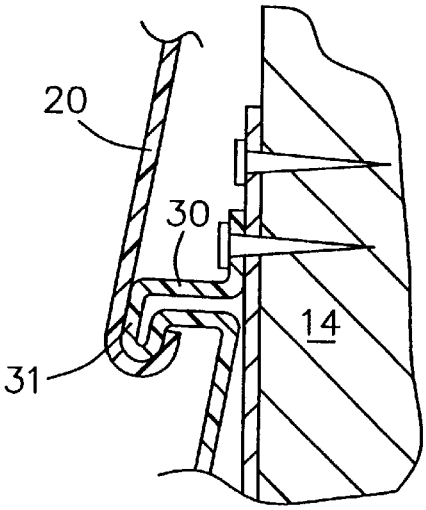
FIG. 4. is an enlarged sectional side view of the top of the drainage apparatus shown in FIG. 2.

In the preferred embodiment, the top of the siding member 12 has an offset wall 30 for accommodating the width of the conduit 11 projecting from the bottom of the exterior wall 14. It will be appreciated that both the top and bottom edges of conventional siding 20 are typically disposed adjacent to the exterior wall 14. The bottom of the siding member 12 in the present invention, however, accommodates the width of the conduit 11 and is horizontally offset from the exterior wall 14, as shown in FIG. 2. To accommodate this horizontal distance and to avoid flexing or bowing of the siding member 12, the top of the siding member has an offset wall 30. As best shown in FIG. 4, the offset wall 30 runs substantially horizontally from the upper clip 31 toward the exterior wall 14. As a result, the siding member 12 is not angled with respect to the rest of the siding 20 on the exterior wall 14. In addition, the magnitude of the offset is relatively minor and therefore the horizontal distance that the siding member 12 is offset from the exterior wall 14 is minimized.

In the preferred embodiment, the siding member 12 carries redirect flaps 24 for guiding water at the interior side of the siding member toward the conduit 11. The redirect flaps are disposed along the interior face of the siding member 12 and are angled down and toward the conduit 11. Each redirect flap 24 is shaped in an elongate strip extending across the width of the siding member 12. The redirect flaps 24 are preferably integrally formed with the siding member 12, although separate members may be used to form the flaps. As illustrated in FIG. 2, the redirect flaps 24 provide a path for water entering the interior side of the siding member 12 which leads directly to the mounting wall 18 of the conduit 11. Water is therefore directed toward the conduit and prevented from backing up through any lower disposed slots.

The siding member also carries a bottom flap 25 for directing water from a bottom slot to the conduit 11. As best shown in FIG. 3, the bottom flap 25 projects downwardly from the interior side of the siding member 12 to engage the conduit 11. The bottom flap 25 is formed in an elongate strip extending across the width of the siding member 12. The bottom flap 25 has a fixed end attached below the bottom slot and a free end disposed near the conduit 11. The bottom flap 25 therefore provides a path for water to travel from the bottom slot to the conduit 11. The bottom flap 25 also ensures that any water traveling along the interior face of the siding member 12 is ultimately directed toward the conduit.

In the preferred embodiment, the siding member 12 further carries an overflow flap 26 for directing water which overflows the front wall 15 of the conduit 11 to a starter strip 28. In normal operation, the conduit 11 is sufficiently large to handle the volume of water produced during a storm. If the conduit somehow becomes plugged, however, the conduit will continue to fill until the water level reaches the height of the front wall 15. Any additional water will flow over the front wall 15 of the conduit 11 and could potentially reach the exterior wall 14 of the building. Accordingly, the preferred embodiment includes an overflow flap 26 which directs the surplus water into the starter strip 28. The overflow flap projects from the interior face of the siding member 12 and is disposed between the front wall 15 of the conduit 11 and the front portion of the starter strip 28. The starter strip 28 carries means for discharging overflow water at a point removed from the exterior wall 14, as described more fully below. Thus, the overflow flap 26 prevents surplus water from reaching the exterior wall 14 of the building.

The use of the bottom flap 25 in conjunction with the overflow flap 26 further facilitates assembly of the drainage apparatus. As best shown in FIG. 3, the bottom and overflow flaps 25, 26 create a recess 27 which accepts the front wall 15 of the conduit 11 and therefore guides the assembly of the siding member 12 with the conduit.

The siding member 12 further provides an appearance that is consistent with the rest of the building wall. According to the illustrated embodiment, the siding member 12 is shaped substantially identical to conventional siding 20 covering the rest of the exterior wall 14 (FIGS. 1 and 2). It will be appreciated that the siding member 12 may be formed into a number of different shapes to conform to various siding shapes covering the rest of the exterior wall 14. As a result, the drainage apparatus 10 does not detract from the appearance of the exterior wall.

The above-mentioned starter strip 28 secures the bottom edge of the siding member 12 and directs surplus water away from the exterior wall 14 in an overflow situation. In the embodiment illustrated in FIG. 2, the starter strip 28 generally has a J- or U-shape comprising a flat portion 32 and a bent portion 34. The flat portion 32 lies substantially adjacent the exterior wall 14 and can be attached to the exterior wall using fasteners such as nails. The bent portion 34 first projects substantially horizontally from the flat portion 32 and then vertically upward. The bent portion 34 is sized to accommodate the width of the conduit 11. A finger 35 projects from the bent portion 34 to provide a groove sized to accept a lower clip 36 of the siding member 12. As best shown in FIG. 3, the lower clip 36 engages the finger 35 along the entire width of the siding member 12 to secure the bottom edge of the siding member.

The starter strip also provides means for directing water away from the exterior wall 14 in an overflow situation. A series of overflow slits 38 are disposed along the width of the starter strip 28 in the bent portion 34, as best shown in FIG. 4. It will be appreciated that if the water level in the conduit becomes higher than the front wall 15, the overflow flap 26 will direct the excess water into the starter strip 28. This excess water will flow out of the starter strip through the overflow slits 38. The overflow slits 38 are horizontally spaced from the exterior wall 14 so that excess water is discharged away from the exterior wall. A tip 40 at the bottom of the flat portion 32 of the starter strip 28 further ensures that excess water does not reach the exterior wall 14. If excess water were to cling to the bottom of the starter strip 28 after passing through the overflow slits 38 to travel toward the flat portion 32, the tip 40 prevents this water from directly reaching the exterior wall 14.

The conduit 11, starter strip 28, and siding member 12 are all constructed from material which resists or prohibits oxidation. Rust-free materials suitable for the present apparatus include aluminum and vinyl, although substitutes known in the art may also be used.

Figure 5:
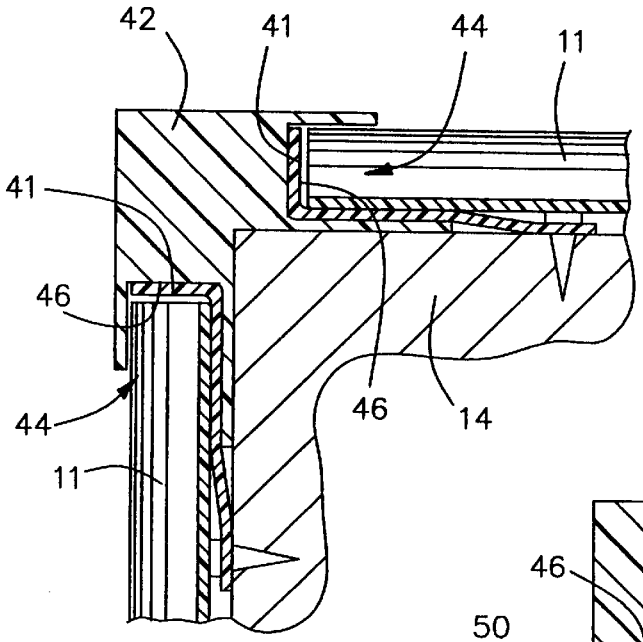
FIG. 5 is a top view showing the drainage apparatus of adjacent walls, the apparatus of each wall having stopping means at the corner.

The present invention further contemplates a number of different options to be incorporated at the corners of a building. With the first option, shown in FIG. 5, a stopping plate 41 is placed at a building corner to prevent the flow of water in that direction. In greater detail, FIG. 5 shows a typical outside corner siding piece 42 of a building. The conduit 11 of the present apparatus fits into a recess 44 of the outside corner 42. Stopping plate 41 is attached to the exterior wall 14 of the building and disposed so that stop lip 46 extends across the width of the conduit 11 from at least the base 16 to the top of the front wall 15 of the conduit. The front edge of the stop lip 46 is sealed to the edge of the conduit 11 using sealants well known in the art. Accordingly, it will be appreciated that the stopping plate 41 prevents water from flowing past the corner.

Figure 6:
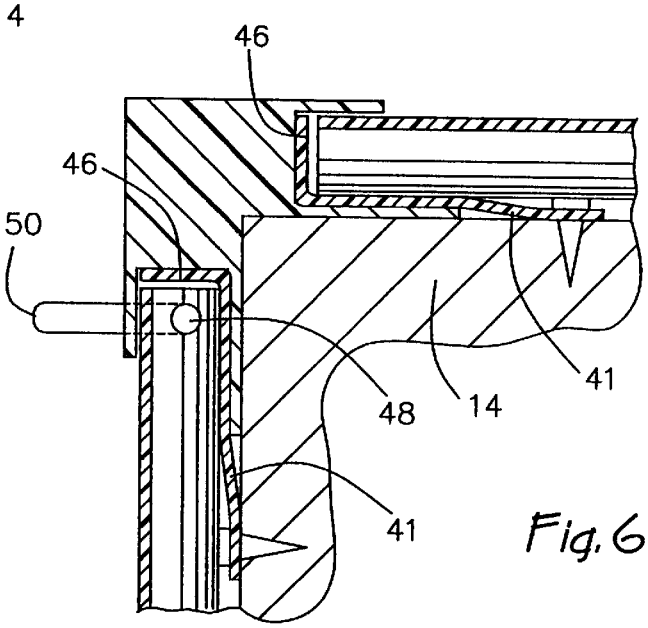
FIG. 6 is a top view showing the drainage apparatus of adjacent walls, the apparatus of one wall having stopping means at the corner and the apparatus of the other wall having drainage means.

With the second option, a drain is located at the corner of the building. As best shown in FIG. 6 a drain hole 48 is located near an end of the conduit 11 allowing water to flow from the conduit through the drain hole. A stopping plate 41 seals off the end of the conduit 11 to prevent leaks. A discharge member is attached to the drain hole 48 for directing the water toward a predetermined point. The discharge member may be a spigot or spout connected to the drain hole 48 and has a discharge end 50 located adjacent the predetermined discharge point.

Figure 7:
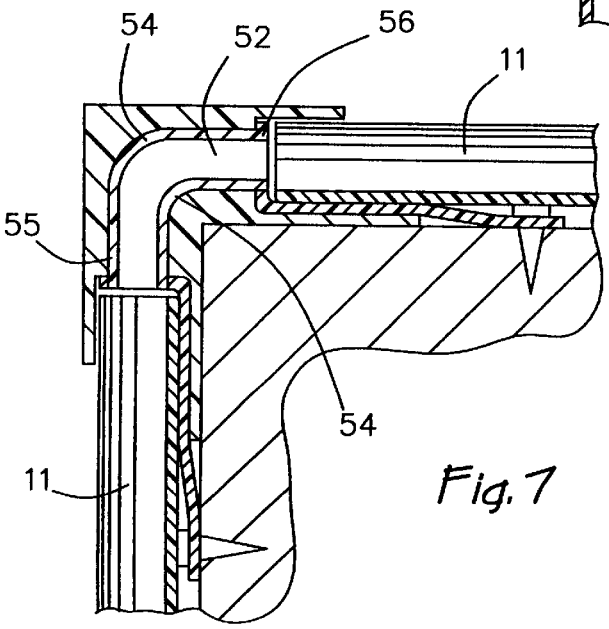
FIG. 7 is a top view showing the drainage apparatus of adjacent walls connected by a corner conduit.

Yet another option for a building corner is to allow the water to pass around the corner to a conduit located on an adjacent wall. As best shown in FIG. 7, corner conduit 52 is located at the building corner which carries water from one conduit to an adjacent conduit. The corner conduit is formed in the shape of a channel in which both side walls 54 are at least high as front wall 15 of conduit 11. The corner conduit 52 is pitched so that water continues to flow from a first end 55, around the corner, to a second end 56 to eventually be discharged into the conduit 11 of an adjacent wall. In this manner, water may be carried from one exterior wall to an adjacent exterior wall.

While the illustrated embodiment depicts the apparatus used on a wood frame building, it will be appreciated that the present invention may be incorporated into a number of different style buildings. For example, the present invention may be used on a brick building by anchoring the top of the siding piece between rows of bricks or between the bottom row of bricks and the building foundation. The conduit and starter strip may be attached to the foundation to complete the apparatus. The present invention may similarly be installed on a steel building. The present invention further contemplates use on rolling doors such as for truck or cargo bays.

From the foregoing, it will be appreciated that the present invention provides drainage apparatus for collecting and directing water which collects on the side of a building exterior wall. Water drawn by gravity along the exterior wall passes through a siding member to collect in a conduit. The conduit is pitched so that the water flows in a predetermined direction. Drains are located at predetermined points along the conduit to discharge the water at selected locations. Means are provided at the building corners for preventing water flow, discharging the water, or carrying the water around the corner to an adjacent conduit on another wall of the building. The apparatus further provides protection in the event that the conduit overflows. Surplus water is directed toward overflow slits in the starter strip which are horizontally spaced from the exterior building wall. As a result, water is prevented from reaching the building foundation, which reduces occurrences of water infiltrating the basement of a building through cracks in the foundation. The present invention is aesthetically pleasing because it conforms to the appearance of the rest of the exterior wall.

What is claimed is:

1. Drainage apparatus for collecting water from an exterior building wall and discharging the water to a predetermined point located away from the building, the apparatus adapted to be attached near the bottom of the exterior wall, the apparatus comprising:

a starter strip adapted for attachment to the exterior wall defining a shallow channel and having a projecting finger;

a conduit defining a deep channel located above and partially inside the shallow channel of the starter strip, the conduit adapted to be attached to the exterior wall on an incline with respect to a horizontal reference plane for guiding water toward an end of the conduit;

a siding member adapted for attachment to the exterior wall and disposed over the conduit, the siding member having interior and exterior sides, a tongue disposed near a bottom edge of the siding member releasably engaging the finger on the starter strip to secure the bottom edge, and means for transferring water from the exterior side to the interior side; and, a discharge member having a first end attached to the end of the conduit and a second end located near the predetermined point;

whereby water from the exterior side of the siding member is collected in the conduit and discharged at the predetermined point.

2. The drainage apparatus of claim 1 wherein the means for transferring water comprises at least one horizontal row of slots extending across substantially an entire width of the siding member.

3. The drainage apparatus of claim 2 wherein a lip is located directly below each horizontal row of slots projecting angularly upwardly from the exterior side of the siding member, the lip extending across substantially the entire width of the siding member.

4. The drainage apparatus of claim 1 wherein the means for transferring water comprises at least one horizontal slot extending across substantially an entire width of the siding member.

5. The drainage apparatus of claim 1 wherein the starter strip comprises a flat portion and a bent portion, the flat portion adapted for attachment to the exterior wall, the bent portion carrying the finger.

6. The drainage apparatus of claim 5 wherein the conduit comprises a front wall, a base, and a mounting wall, the conduit being partially inserted into the starter strip so that at least part of the base is located substantially adjacent to the bent portion of the starter strip.

7. The drainage apparatus of claim 6 wherein the mounting wall extends above a top edge of the siding member to present a surface adapted for mounting the conduit to the exterior wall.

8. The drainage apparatus of claim 6 wherein edges of the conduit taper inwardly from the base to facilitate attachment of the conduit to the exterior wall on the incline.

9. The drainage apparatus of claim 1 wherein the siding member incorporates at least one redirect flap for directing water on the inside face of the siding member toward the conduit, each redirect flap comprising an elongate strip extending across substantially an entire horizontal width of the siding member and projecting from the interior side of the siding member at a downward angle.

10. The drainage apparatus of claim 1 wherein the siding member incorporates a bottom flap for directing water from a bottom slot toward the deep channel of the conduit, the bottom flap comprising an elongate strip extending across substantially an entire horizontal width of the siding member, the bottom flap having a fixed end attached to the interior side of the siding member below a bottom slot and a free end which engages the conduit, the bottom flap angled downwardly and into the deep channel.

11. The drainage apparatus of claim 1 wherein a series of holes are located in the bent portion of the starter strip at a distance spaced from the flat portion sized to permit water to pass through.

12. Drainage apparatus for collecting water from an exterior building wall and discharging the water at a predetermined point located away from the building, the apparatus adapted to be attached near the bottom of the exterior wall, the apparatus comprising:

a starter strip defining a shallow channel having a flat portion adapted for attachment to the exterior wall and a bent portion carrying a projecting finger;

a conduit defining a deep channel located above and partially inside the shallow channel of the starter strip, the conduit adapted to be attached to the exterior wall on an incline with respect to a horizontal reference plane for guiding water toward an end of the conduit;

an elongate siding member adapted for attachment to the exterior wall and disposed over the conduit, the siding member having interior and exterior sides, a tongue disposed near a bottom edge engaging the finger on the starter strip to secure a bottom edge of the siding member, and means for carrying water from the exterior side to the interior side, the siding member formed in the shape of conventional siding and having at least one outside bend; and a discharge member having a first end attached to the end of the conduit and a second end located near the predetermined point;

whereby water from the exterior side of the siding member is collected in the conduit and discharged at the predetermined point.

13. The drainage apparatus of claim 12 wherein the means for transferring water comprises a horizontal slot disposed below each bend in the siding member.

14. The drainage apparatus of claim 12 wherein the means for transferring water comprises at least one row of slots disposed directly below each bend in the siding member.

15. The drainage apparatus of claim 14 wherein a lip is located directly below each row of slots and projects angularly upward from the exterior side of the siding member.

16. The drainage apparatus of claim 12 wherein the conduit comprises a front wall, a base, and a mounting wall, the conduit being partially inserted into the starter strip so that at least part of the base is located substantially adjacent to the bent portion of the starter strip.

17. The drainage apparatus of claim 16 wherein edges of the conduit taper inwardly from the base to attachment of the conduit to the exterior wall on an incline.

18. The drainage apparatus of claim 12 wherein the siding member incorporates at least one redirect flap for directing water on the inside face of the siding member toward the conduit, each redirect flap comprising an elongate strip extending across substantially an entire horizontal width of the siding member and projecting from the interior side below each bend at a downward angle.

19. The drainage apparatus of claim 12 wherein the siding member incorporates a bottom flap for directing water from a bottom slot toward the deep channel of the conduit, the bottom flap comprising an elongate strip extending across substantially an entire horizontal width of the siding member, the bottom flap having a fixed end attached to the interior side of the siding member below a bottom slot and a free end which engages the conduit, the bottom flap angled downwardly and into the deep channel.

20. The drainage apparatus of claim 12 wherein a series of holes are located in the bent portion of the starter strip at a distance spaced from the flat portion sized to permit water to pass through.

* * * * *